US011365101B1

(12) United States Patent
Jazwick et al.

(10) Patent No.: US 11,365,101 B1
(45) Date of Patent: Jun. 21, 2022

(54) AIDED FREEWHEEL WINCH ASSEMBLY

(71) Applicant: Altec Industries, Inc., Birmingham, AL (US)

(72) Inventors: Dusty Jazwick, Omaha, NE (US); Robert Nichols, Saint Joseph, MO (US)

(73) Assignee: Altec Industries, Inc., Birmingham, AL (US)

( * ) Notice: Subject to any disclaimer, the term of this patent is extended or adjusted under 35 U.S.C. 154(b) by 0 days.

(21) Appl. No.: 17/388,697

(22) Filed: Jul. 29, 2021

(51) Int. Cl.
*B66D 1/50* (2006.01)
*B66D 1/08* (2006.01)
*B66D 3/02* (2006.01)

(52) U.S. Cl.
CPC ..... *B66D 1/505* (2013.01); *B66D 1/08* (2013.01); *B66D 3/02* (2013.01); *B66D 2700/0133* (2013.01); *B66D 2700/0191* (2013.01)

(58) Field of Classification Search
CPC ..... B66D 1/485; B66D 1/505; B66D 1/08; B66D 1/12; B66D 2700/0133; B66D 2700/0141; B66D 2700/0191
See application file for complete search history.

(56) References Cited

U.S. PATENT DOCUMENTS 3,066,917 A 12/1962 Tuplin et al.
4,928,925 A * 5/1990 Christison ..... B63B 23/50 254/264
5,048,826 A * 9/1991 Ryan ..... A63B 21/078 482/7
6,035,465 A * 3/2000 Rogozinski ..... A61G 5/02 5/83.1
6,926,260 B1 * 8/2005 De Groot ..... B66D 3/043 254/277
2005/0179020 A1 * 8/2005 Taylor ..... B66D 1/485 254/270
2010/0051767 A1 * 3/2010 Erel ..... B66C 23/02 248/205.1
2012/0105242 A1 * 5/2012 Pereira ..... G01L 5/102 340/668
2012/0328372 A1 * 12/2012 Hawkes ..... B65H 75/425 405/177
2014/0248089 A1 * 9/2014 Thompson ..... B66D 1/505 405/184.3
2016/0159625 A1 6/2016 Janik et al.
2016/0200437 A1 * 7/2016 Ryan ..... B64C 39/022 244/99.2
2016/0347594 A1 * 12/2016 Shmueli ..... B66D 1/7457
2017/0175501 A1 * 6/2017 van der Ende ..... E21B 47/06
2017/0320592 A1 * 11/2017 Chen ..... B64F 1/04

FOREIGN PATENT DOCUMENTS

EP 3040305 A1 * 7/2016 ..... B66D 1/505

* cited by examiner

*Primary Examiner* — Emmanuel M Marcelo
(74) *Attorney, Agent, or Firm* — Erise IP, P.A.

(57) ABSTRACT

Systems, devices, and assemblies for providing winch freewheel functionality and maintaining tension in a winch line of a winch system. An operator input is detected using at least one sensor. The operator input is associated with an operator pulling on the winch line and a pay-out function of a winch motor of the winch system is controlled based on the operator input.

20 Claims, 8 Drawing Sheets

AIDED FREEWHEEL WINCH ASSEMBLY

BACKGROUND

1. Field

Embodiments of the invention relate to winch systems. More specifically, embodiments of the invention relate to an aided freewheel assembly for use with a winch system.

2. Related Art

Freewheel winch operation has been used to allow operators to manually pull a winch line to release the line from a winch system by disengaging a winch drum from a winch gearbox and power source of the winch system. However, the force required to release the winch line is typically very high due to resistance in the winch drum and friction between the winch line and other components of the system which make it difficult for the operator to release the winch line. Additionally, prior freewheel winch operation may lead to bird-nesting and uneven wrapping of the winch line during winch pay-in.

Traction winches have been used to eliminate the issues of bird-nesting and uneven wrapping of the winch line by maintaining constant tension in the winch line. However, the winch line cannot be released manually from traction winches as the construction thereof does not allow for freewheel functionality.

SUMMARY

Embodiments of the invention solve the above-mentioned problems by providing an aided freewheel device capable of providing freewheel-like functionality while still maintaining tension in the winch line. In some embodiments, the aided freewheel device provides an aided freewheel functionality in which control of a winch system is based on a detected operator input from an operator manually pulling on the winch line.

A first embodiment of the invention is directed to a system for aiding winch operation, the system comprising a rigid base structure, a winch line, one or more winch guides secured to the rigid base structure and in contact with the winch line for reducing friction on the winch line as the winch line is moved, a roller in contact with the winch line, an arm secured to the rigid base structure for supporting the roller, an actuator coupled to the arm for exerting a force on the roller, wherein the force maintains contact of the roller with the winch line, a winch motor for paying in and paying out the winch line, and a sensor disposed on the arm for measuring a change in position of the roller from a reaction force of the winch line, wherein the measured change in position is indicative of an operator input, wherein an operation of the winch motor is controlled based at least in part on the measured change in position from the sensor.

A second embodiment of the invention is directed to a device for aiding winch operation, the device comprising a rigid base structure, a winch line, one or more winch guides secured to the rigid base structure and in contact with the winch line for reducing friction on the winch line as the winch line is moved, a roller in contact with the winch line, a winch motor for paying in and paying out the winch line, and a sensor disposed on or adjacent to the roller for measuring a change in position of the roller from a reaction force of the winch line, wherein the measured change in position is indicative of an operator input, wherein operation of the winch motor is controlled based at least in part on the measured change in position from the sensor.

A third embodiment of the invention is directed to an aided freewheel winch assembly, the assembly comprising a rigid base structure, one or more winch guides secured to the rigid base structure and in contact with a winch line of a winch assembly for reducing friction on the winch line as the winch line is moved, and at least one sensor disposed adjacent to the winch line for detecting a tension in the winch line indicative of an operator input, wherein a pay-out function of the winch assembly is controlled based at least in part on the detected tension in the winch line.

Additional embodiments of the invention are directed to a tensioner assembly for maintaining a constant tension within a winch line. The tensioner assembly comprising a tensioner motor, tensioner sheave, and tensioner cylinder.

Further, embodiments are directed to a control system for controlling winch operations such as pay-in and pay-out functions based on a received operator input from an operator pulling on a winch line.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the invention will be apparent from the following detailed description of the embodiments and the accompanying drawing figures.

BRIEF DESCRIPTION OF THE DRAWING FIGURES

Embodiments of the invention are described in detail below with reference to the attached drawing figures, wherein.

Figure 1:
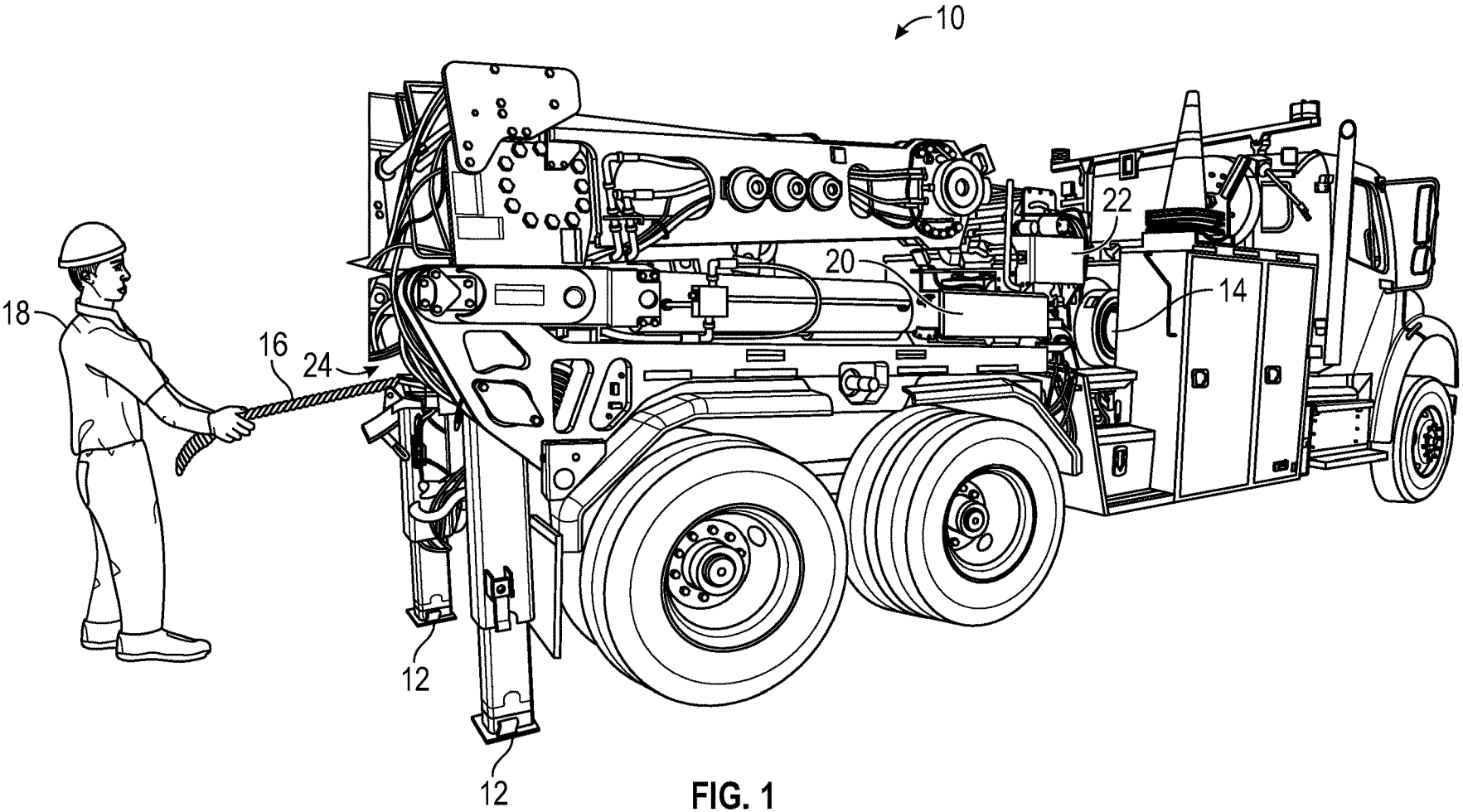
FIG. 1 depicts a utility vehicle relating to some embodiments.

The drawing figures do not limit the invention to the specific embodiments disclosed and described herein. The drawings are not necessarily to scale, emphasis instead being placed upon clearly illustrating the principles of the invention.

DETAILED DESCRIPTION

The following detailed description references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the invention. The following detailed description is, therefore, not to be taken in a limiting sense. The scope of the invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the technology can include a variety of combinations and/or integrations of the embodiments described herein.

Typical forms of freewheel operation involve disengaging the winch drum such that the winch drum can be rotated manually. Conversely, embodiments of the present disclosure simulate freewheel winch operation by detecting an operator input associated with an operator pulling on a winch line and controlling winch operation based on said operator input.

Turning first to FIG. 1, a utility vehicle 10 is depicted relating to some embodiments. In some embodiments, the utility vehicle 10 may be a cable handling truck, as shown. Alternatively, in some embodiments, the utility vehicle 10 may be a digger derrick or include an aerial device with a boom. In some embodiments, the utility vehicle 10 comprises one or more outriggers 12 for stabilizing the utility vehicle 10 during operation. For example, the utility vehicle 10 may include two outriggers 12 disposed at the back of the utility vehicle which may be deployed while the utility vehicle 10 is in stationary operation.

In some embodiments, a winch assembly 14 may be included on the utility vehicle 10. For example, the winch assembly 14 may be disposed within a bed or on a deck of the utility vehicle 10, as shown. In some embodiments, the winch assembly 14 comprises a winch motor, a winch drum, and a winch brake. In some embodiments, the winch assembly 14 may be operated either automatically or manually such that the winch assembly 14 automatically pays a winch line 16 in or out from the winch drum. For example, in some embodiments, the winch assembly 14 comprises a traction winch which may be actively driven during either of a pay-in or pay-out operation. During automatic operation, the winch motor may be actively driven to turn the winch drum to thereby adjust the length of the winch line 16. In some embodiments, an operator 18 may hold the winch line 16 during operation, as shown.

In some embodiments, the utility vehicle 10 may further comprise a first input device 20 for controlling one or more operations of the utility vehicle 10 or components attached thereto. Additionally, the utility vehicle 10 may comprise a second input device 22 for controlling one or more additional operations of the utility vehicle 10 or of the winch assembly 14. In some embodiments, either of the first input device 20 and the second input device 22 may be operated by the operator 18 or by another operator. For example, the second input device 22 may receive one or more operator inputs from the operator 18 to control operation of the winch assembly 14, such as paying out the winch line 16.

In some embodiments, an aided freewheel winch assembly 24 may be included on the utility vehicle 10. In some such embodiments, the aided freewheel winch assembly 24 may be disposed within a bed of the utility vehicle 10 or internal to the utility vehicle 10, as shown, such that the aided freewheel winch assembly 24 is not visible externally. In some such embodiments, the aided freewheel winch assembly 24 may be coupled to the winch line 16 to provide aided freewheel operation by sensing an operator input from the winch line 16. For example, the aided freewheel winch assembly 24 may detect whether the operator 18 is pulling on the winch line 16 to instruct a pay-out function of the winch assembly 14 to thereby release additional length of the winch line 16.

Further, embodiments are contemplated in which at least a portion of the components described herein with respect to FIG. 1 may be disposed on a mobile trailer or a stationary structure. Accordingly, embodiments are contemplated in which the winch assembly 14 and the aided freewheel winch assembly 24 may be included independently and may be secured to any suitable structure. Additionally, in some embodiments, a cover may be configured to be placed over the aided freewheel winch assembly 24 to protect one or more moving parts of the aided freewheel winch assembly 24.

Figure 2A:
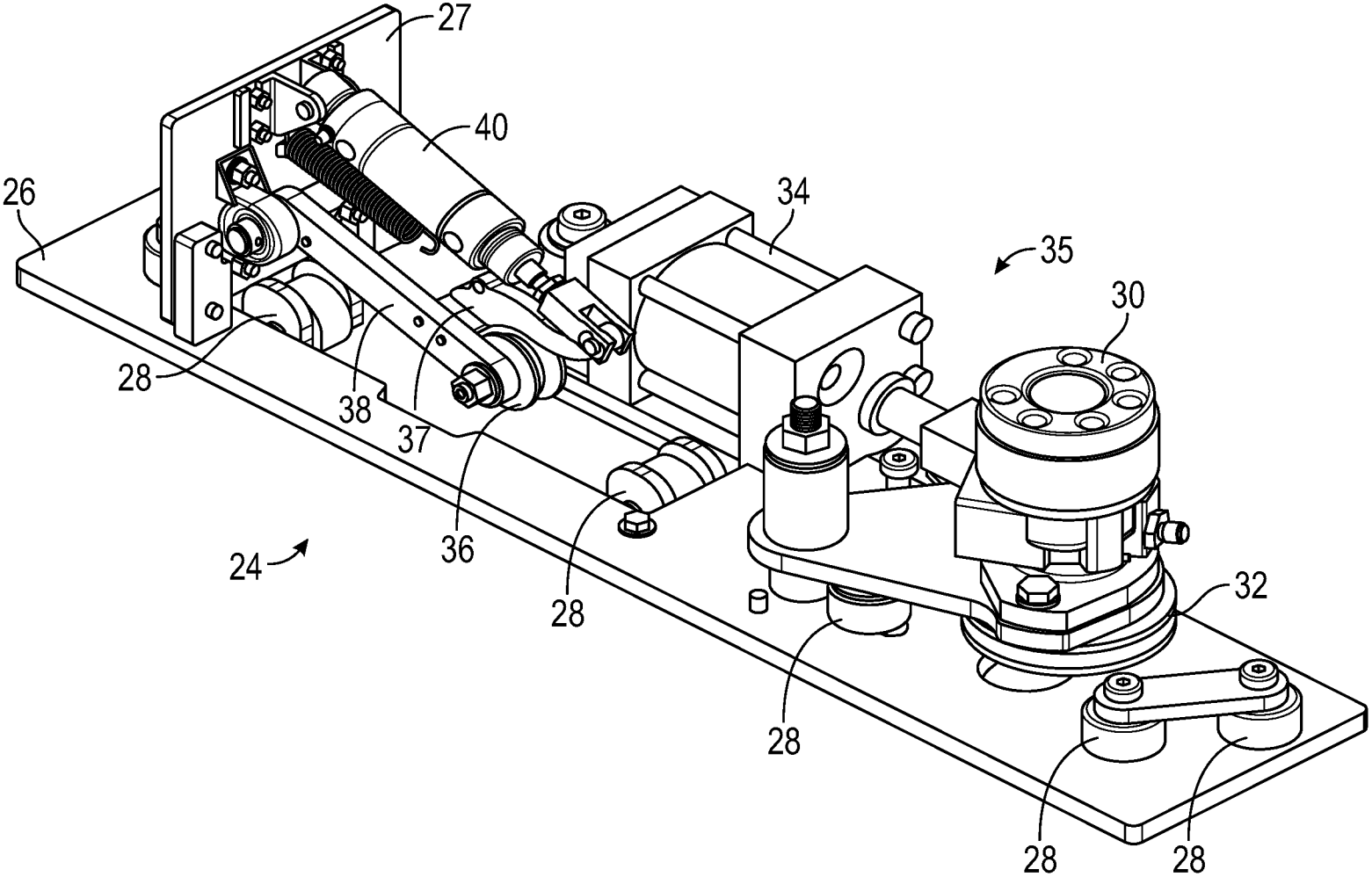
FIG. 2A depicts an isometric view of an aided freewheel winch assembly relating to some embodiments.

Turning now to FIG. 2A, an isometric view of the aided freewheel winch assembly 24 is depicted relating to some embodiments. In some embodiments, the aided freewheel winch assembly 24 comprises a rigid base structure 26 for holding the aided freewheel winch assembly 24 in place. In some such embodiments, the rigid base structure 26 may comprise a rigid frame which may be formed out of plate metal or another rigid material. Further, in some embodiments, the rigid base structure 26 may be secured to one or more other structures such as, for example, a portion of the utility vehicle 10 or another structure. In some embodiments, the rigid base structure 26 may be a portion of the utility vehicle 10, such that the remaining components of the aided freewheel winch assembly 24 are secured directly to the utility vehicle 10. Further, embodiments are contemplated in which the rigid base structure 26 is part of or is attached to a frame of the winch assembly 14. Accordingly, in such embodiments, the aided freewheel winch assembly 24 may be disposed on the winch assembly 14. In some embodiments, the rigid base structure 26 comprises a vertical portion 27 extending substantially vertically from the rigid base structure 26, as shown.

In some embodiments, the aided freewheel winch assembly 24 further comprises one or more winch guides 28 which may be rotationally secured to the rigid base structure 26. In some embodiments, each of the winch guides 28 comprises a pulley, a roller, or a sheave for reducing friction on the winch line 16 when the winch line 16 is moved. For example, the winch guides 28 may comprise one or more bearings such that the winch guides 28 are easily rotated to facilitate movement of the winch line 16.

In some embodiments, the aided freewheel winch assembly 24 comprises a tensioner motor 30 for maintaining tension within the winch line 16. In some embodiments, the tensioner motor 30 may be operable as either of a drive or a brake for the winch line 16 during respective pay-out and pay-in operations. The tensioner motor 30 may be any of a hydraulic motor, a pneumatic motor, an electric motor, or any other type of motor operable to provide driving or braking force. Alternatively, in some embodiments, separate components may be included for providing respective driving and braking forces. In some embodiments, the tensioner motor 30 may be coupled to a tensioner sheave 32 which may be engaged with the winch line 16 during operation such that the winch line 16 does not slip with respect to the tensioner sheave 32. In some embodiments, the tensioner sheave 32 may apply appropriate friction to hold the winch line 16 in place. Accordingly, in some embodiments, the tensioner sheave 32 may include either of a U-shaped groove or a V-shaped groove for receiving the winch line 16.

In some embodiments, the tensioner motor 30 may be coupled to the winch line 16 using the tensioner sheave 32. However, it should be understood that a variety of other components may be used to couple the tensioner motor 30 and the winch line 16. For example, embodiments are contemplated in which the winch line 16 is received into one or more grooved blocks secured to a conveyer assembly driven by the tensioner motor 30. Here, each of the grooved blocks comprise a groove for receiving the winch line 16 and providing a non-slip contact point with the winch line 16 to apply either of a drag or drive force during operation. In some embodiments, the conveyer assembly comprises a belt or a chain placed around two or more gears or pulleys. At least one of the gears or pulleys may be coupled to the tensioner motor 30 such that they may be actively driven during operation. Alternatively, embodiments are contemplated in which a roller or another component may be used to couple the tensioner motor 30 to the winch line 16.

In some embodiments, the aided freewheel winch assembly 24 further comprises a tensioner cylinder 34 which may be coupled to the tensioner motor 30 to either engage or disengage the tensioner motor 30 and tensioner sheave 32 with the winch line 16. In some such embodiments, the tensioner cylinder 34 may comprise a pneumatic cylinder, a hydraulic cylinder, or an electrically actuated cylinder. In some embodiments, each of the winch guides 28, the tensioner motor 30, the tensioner sheave 32, and the tensioner cylinder 34 may be used to maintain tension within the winch line 16 such that the winch line 16 is wrapped evenly within the winch assembly 14 and tangles and bird-nesting of the winch line 16 are avoided.

In some embodiments, the tensioner motor 30, the tensioner sheave 32 and the tensioner cylinder 34 form a tensioner assembly 35 of the aided freewheel winch assembly 24 for maintaining tension within the winch line 16. In some such embodiments, the tensioner assembly 35 may be used to create a resistance on the winch line 16 while the winch assembly 14 is paying in, maintain tension in the winch line 16 when the winch assembly 14 is paying out, and/or aid the operator 18 when pulling on the winch line 16 in a freewheel mode of operation. In some embodiments, said tensioner assembly 35 may be included as a stand-alone system with or without at least a portion of the remaining components of the aided freewheel winch assembly 24. The tensioner assembly 35 may be used to maintain a constant tension in the winch line 16 to prevent uneven wrapping and bird-nesting.

In some embodiments, the tensioner assembly 35 may be used to provide a resistance in the winch line 16 while the winch assembly 14 is paying in by extending the tensioner cylinder 34 such that the tensioner sheave 32 contacts the winch line 16 with a zero slip friction connection. During a pay-in operation of the winch assembly 14, the tensioner motor 30 acts passively as a pump by creating a pressure differential across the tensioner motor 30, which is a hydraulic motor in such embodiments. In some such embodiments, the pressure is established using a relief valve set to a specific pressure value such that hydraulic oil will flow beyond the specific pressure value. In some embodiments, the pressure differential of the tensioner motor 30 correlates to a resistance force acting against the winch assembly 14. Additionally, in some embodiments, a low pressure hydraulic oil may be supplied at another side of the tensioner motor 30 (opposite the relief valve) to prevent a vacuum.

Additionally, in some embodiments, the tensioner assembly 35 may be used to maintain tension in the winch line 16 during a pay-out operation of the winch assembly 14. In such a mode of operation, the tensioner motor 30 is actively driven by providing a pressure to one side of the tensioner motor 30. In some embodiments, during pay-out operation, the tensioner motor 30 is driven in the same direction as the winch pay-out from the winch assembly 14. Here, tension in the winch line 16 is maintained by driving the tensioner motor 30 faster than the speed of the winch motor of the winch assembly 14.

In some embodiments, the tensioner assembly 35 further comprises a tensiometer disposed adjacent to the winch line 16 for measuring the tension in the winch line 16 and a proximity sensor for determining a length of the winch line 16 that travels through the proximity sensor. Additionally, in some embodiments, a speed sensor may be integrated into the tensioner motor 30 for measuring a rotational speed of the tensioner motor 30. Accordingly, the speed of the winch line 16 as determined by the proximity sensor and the speed of the tensioner motor 30 may be compared to determine whether the tensioner sheave 32 is slipping with respect to the winch line 16. If the tensioner sheave 32 is determined to be slipping from the winch line 16, the tensioner assembly 35 may be automatically disengaged from the winch line 16. In some embodiments, the tensioner assembly 35 may also be automatically disengaged if the tension in the winch line 16 exceeds a predetermined tension to extend the life of the tensioner assembly 35. The tensioner assembly 35 may be operable to re-engage once the tension in the winch line 16 drops below the predetermined tension. Further, in some embodiments, the tensioner assembly 35 may be disengaged manually by the operator 18 using one of input devices 20, 22, or another input device associated with the tensioner assembly 35.

In some embodiments, the aided freewheel winch assembly 24 comprises a contact device, such as roller 36, which may be disposed on or near an end of an arm 38, which may be rotatably secured to the rigid base structure 26. In some embodiments, the contact device may be a slide pad, such as with a groove, or other planar or curved surface to receive the winch line 16 thereon. In some embodiments, one end of the arm 38 may be pivotably connected to the vertical portion 27 of the rigid base structure 26, as shown. In some embodiments, arm 38 may be movably mounted to the vertical portion 27, such that it can be moved vertically up or down. Accordingly, the arm 38 may support the roller 36 while also allowing rotation of the roller 36. In some embodiments, the roller 36 may include a groove for receiving the winch line 16 and may also include one or more bearings for providing smooth rotation of the roller 36. In some embodiments, an actuator 40 may be coupled to the arm 38 via a connecting member 37 for exerting a force on the roller 36 through the arm 38. The actuator 40 may be rotatably secured to the rigid base structure 26, such as on the vertical portion 27, as shown. In some embodiments, the actuator 40 may be any of a pneumatic actuator, a hydraulic actuator, an electric actuator, or any other suitable type of actuator operable to exert a force on the roller 36 such that the roller 36 contacts the winch line 16. In some embodiments, the connecting member 37 may be bolted or otherwise anchored to either of the arm 38 or the actuator 40, as shown, for transferring a force from the actuator 40 to the arm 38. Alternatively, in some embodiments, other suitable types of fastening means may be employed to attach the connecting member 37 to the arm 38 and the actuator 40. Further, embodiments are contemplated in which the actuator 40 is directly connected to the arm 38 such that the connecting member 37 is not included.

In some embodiments, the arm 38 and the actuator 40 may be mechanically coupled such that when one of either of the components is moved the other component moves in unison. Accordingly, when the actuator 40 is extended, a force is exerted on the arm 38. Further, when a sufficient tension exists in the winch line 16, the roller 36 may be pushed upwards (in a direction opposite from the winch line 16) such that the arm 38 is displaced, which thereby displaces the actuator 40. Accordingly, a force exerted by the actuator 40 may be used to tune the system to a specific tensile force of the winch line 16, as will be described in further detail below.

Figure 2B:
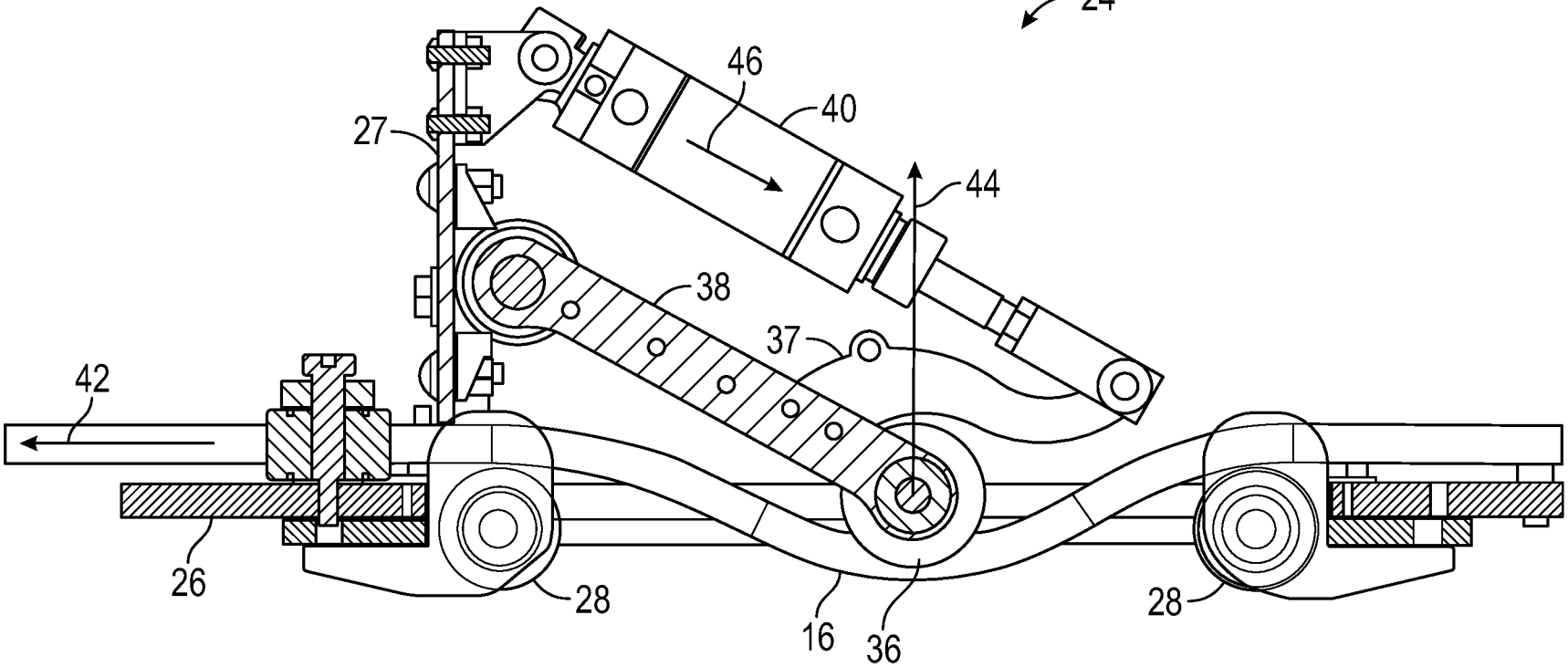
FIG. 2B depicts a side view of an aided freewheel winch assembly relating to some embodiments.

Turning now to FIG. 2B, a side view of the aided freewheel winch assembly 24 is depicted relating to some embodiments. During operation, the winch line 16 is placed within the aided freewheel winch assembly 24 such that the winch line 16 contacts the winch guides 28, as shown. When the operator 18 pulls the winch line 16 an operator force 42 is exerted on the winch line 16, as shown. The operator force 42 causes the winch line 16 to exert a reaction force 44 onto the roller 36 due to the tension in the winch line 16, as shown. Accordingly, various sensing means may be used to either detect the operator force 42 directly or to infer the operator force 42 by measuring the reaction force 44. Further, in some embodiments, various other suitable means of detection may be used, as will be described in further detail below.

In some embodiments, an exerted force 46 is exerted by the actuator 40 onto the arm 38 and is transmitted through the roller 36. Said exerted force 46 may push the roller 36 into contact with the winch line 16, as shown. In some embodiments, the exerted force 46 from the actuator 40 is predetermined such that at least one component of the exerted force 46 may be compared to the reaction force 44. For example, in some embodiments, the actuator 40 exerts a force with a vertical component of a known magnitude. Accordingly, if the position of the roller 36 is moved upwards it can be determined that the reaction force 44 exceeds the vertical component of the exerted force 46 from the actuator 40, which may be indicative of an input from an operator 18. In some embodiments, the sensitivity of the aided freewheel winch assembly 24 may be adjusted by varying the magnitude of the exerted force 46 from the actuator 40. For example, in some embodiments, the exerted force 46 may be increased by increasing the power of the actuator 40 such that a higher operator force 42 is required to change the position of the roller 36. Alternatively, in some embodiments, the exerted force 46 may be decreased such that a lower operator force 42 is required to change the position of the roller 36. Further, embodiments are contemplated in which the exerted force 46 is selectable by the operator 18 or by another user, or automatically.

In some embodiments, at least one function of the winch assembly 14 or of the aided freewheel winch assembly 24 may be controlled based at least in part on the measured reaction force 44. Further, embodiments are contemplated in which the reaction force 44 may be measured indirectly, such as for example, by measuring a change in position of the roller 36. In this case, a function of the winch assembly 14 or the aided freewheel winch assembly 24 may be carried out based on said measured change in position. Accordingly, in some embodiments, a pay-in or pay-out function of the winch assembly 14 may be initiated based on the reaction force 44. For example, embodiments are contemplated in which the operator 18 pulls on the winch line 16 to apply operator force 42, as shown. The operator force 42 increases tension on the winch line 16, which pushes against the roller 36 with a reaction force 44 proportional to the operator force 42. As such, the exerted force 46 from the actuator 40 may be compared to the reaction force 44 and/or to the operator force 42 to determine an operator input. In some embodiments, the magnitude of the operator force 42 may be inferred, for example, by measuring the amount of change in the position of the roller 36. Accordingly, embodiments are contemplated in which the speed of the winch line 16 paid out from the winch assembly 14 may be determined based on the measured change in the position or measured force. For example, if the operator force 42 increases, the payout speed of the winch assembly 14 may be increased proportionally.

In some embodiments, at least one function of the tensioner motor 30, tensioner sheave 32, and/or the tensioner cylinder 34 may be determined based on the operator force 42. For example, in some embodiments, a speed and/or a braking force of the tensioner motor 30 may be adjusted based on a sensed operator input. Further, in some embodiments, the arm 38 and the roller 36 may be repositioned during at least one operation of the winch assembly 14. For example, in some embodiments, the arm 38 may be moved away from the winch line 16 when the aided freewheel winch assembly 24 is not in a freewheel mode such that the roller 36 does not contact the winch line 16. Additionally, in some embodiments, the arm 38 may be moved away from the winch line 16 while the winch assembly 14 is performing either of a pay-in or pay-out function (even while the aided freewheel winch assembly 24 is in a freewheel mode), such that the arm 38 and roller 36 are moved out of the way.

Figure 3A:
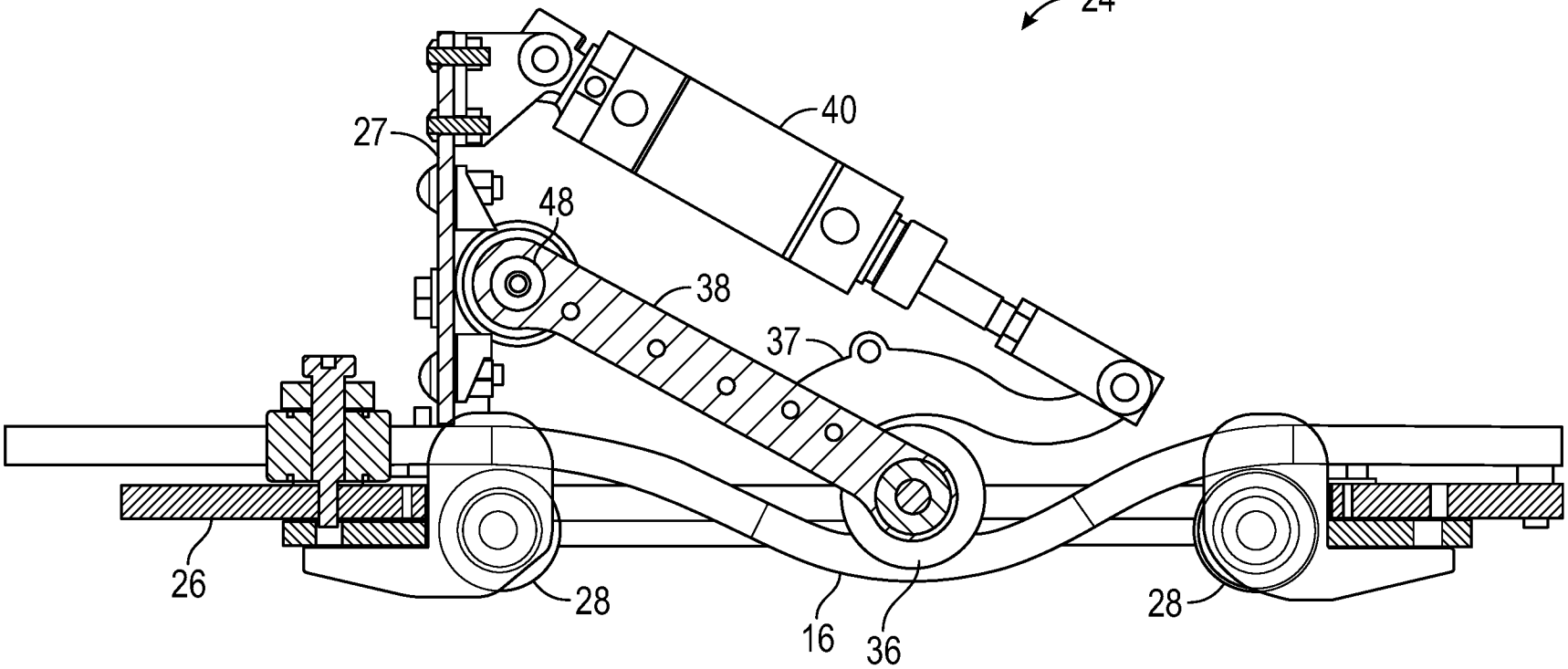
FIG. 3A depicts a side view of an aided freewheel winch assembly including a rotary encoder relating to some embodiments.

Turning now to FIG. 3A, a side view of the aided freewheel winch assembly 24 is depicted including a rotary encoder 48 relating to some embodiments. In some such embodiments, the rotary encoder 48 may be disposed on the arm 38 or at or near a connection pin of the arm 38 which rotatably secures the arm 38 to the rigid base structure 26, as shown. In some embodiments, at least a portion of the rotary encoder 48 is configured to rotate with the arm 38 such that rotation of the arm 38 may be detected. In some embodiments, the rotary encoder 48 comprises at least one wire for sending a signal indicative of the detected rotation. In some such embodiments, the at least one wire may be electrically connected to a control system of the winch assembly 14. Alternatively, embodiments are contemplated in which a signal indicative of the detected rotation is transmitted wirelessly from the rotary encoder 48. Further, in some embodiments, the rotary encoder 48 may be disposed elsewhere, such as on the roller 36 or on the actuator 40.

In some embodiments, the detected rotation from the rotary encoder 48 is used to determine a change in the position of the winch line 16 and the roller 36 based on the length of the arm 38. For example, the length of the arm 38 from the connection to the rigid base structure 26 to the center of the roller 36 may be multiplied by the sine of the measured angle to determine the change in position of the roller 36 from the tension in the winch line 16 associated with the operator 18 pulling the winch line 16.

Figure 3B:
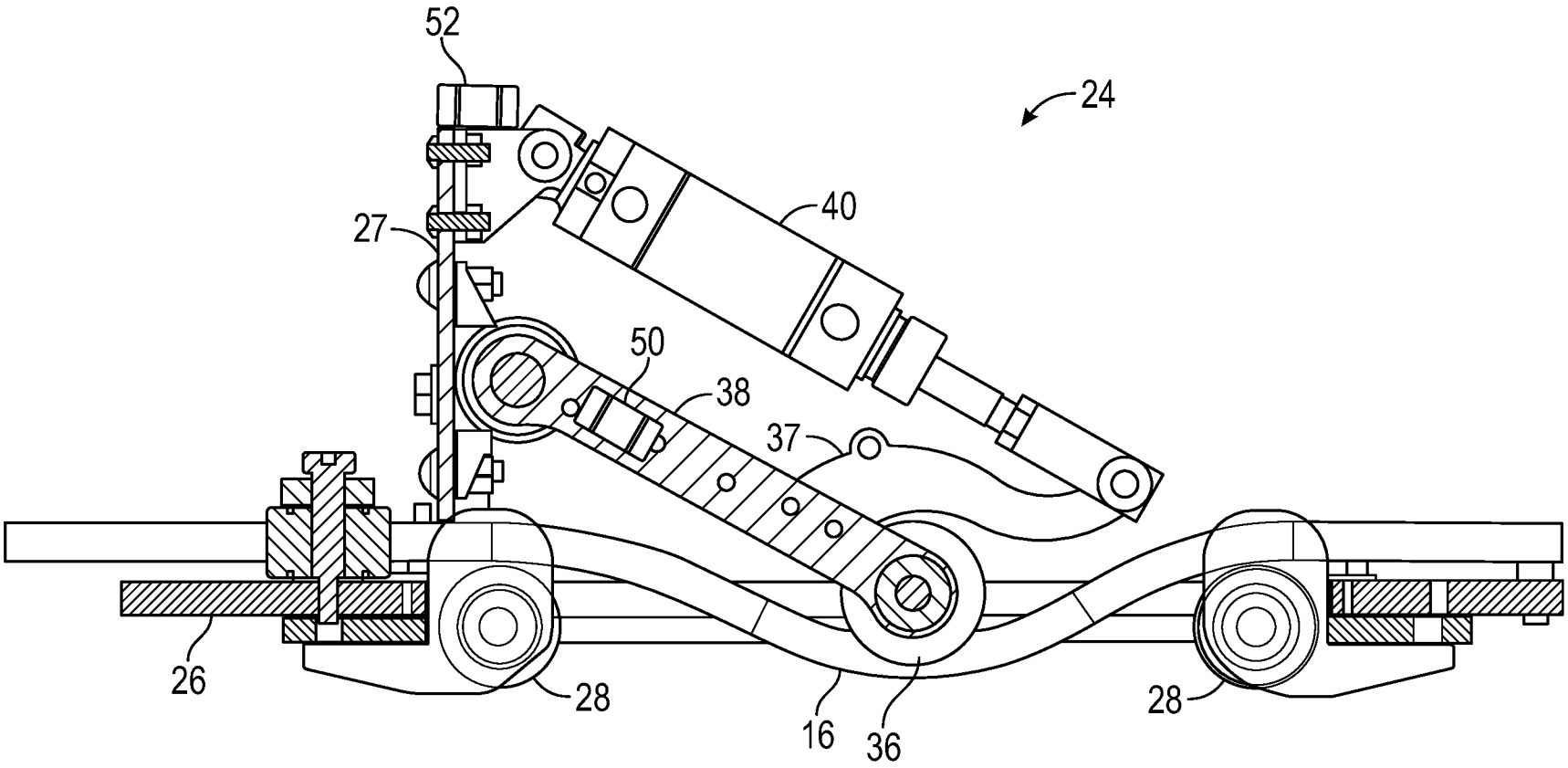
FIG. 3B depicts a side view of an aided freewheel winch assembly including an inclinometer relating to some embodiments.

Turning now to FIG. 3B, a side view of the aided freewheel winch assembly 24 is depicted including at least a first inclinometer 50 relating to some embodiments. In some embodiments, the first inclinometer 50 is mounted on or coupled to the arm 38. For example, in some embodiments, the first inclinometer 50 is mounted along a length of the arm 38, as shown. Accordingly, the first inclinometer 50 may be configured to measure an angle of inclination of the arm 38 with respect to the direction of gravity.

In some embodiments, a second inclinometer 52 may be included as a reference inclinometer. For example, the second inclinometer 52 may be mounted on the rigid base structure 26 to measure an angle of inclination of the rigid base structure 26. Here, the measured angle of inclination from the second inclinometer 52 may be used to subtract a bias from the first inclinometer 50 such that an angle difference between the arm 38 and rigid base structure 26 is determined. In some embodiments, it may be desirable to remove a bias from the first inclinometer 50 such that accurate angle measurements may be produced even when the entire aided freewheel winch assembly 24 is at an angle with respect to the direction of gravity. In some embodiments, the second inclinometer 52 may be mounted on top of the vertical portion 27 of the rigid base structure 26, as shown. However, in some embodiments, the second inclinometer 52 may be mounted elsewhere on the rigid base structure 26 where vibration is minimized to reduce noise and ensure accurate measurements.

In some embodiments, the measured angles from the inclinometers 50 and 52 may be used to determine a change in position of the roller 36 similarly to as described above with respect to the rotary encoder 48. Here, the length of the arm 38 may be multiplied by the sine of the angle difference between the encoder measurements to determine the change in position. However, it should be understood that various different calculations and trigonometric relationships may be used based on the specific arrangement of the sensing devices and the aided freewheel winch assembly 24. Further, in some embodiments, the change in position may not need to be determined and the winch operation may be controlled based on a change in angle directly.

Figure 3C:
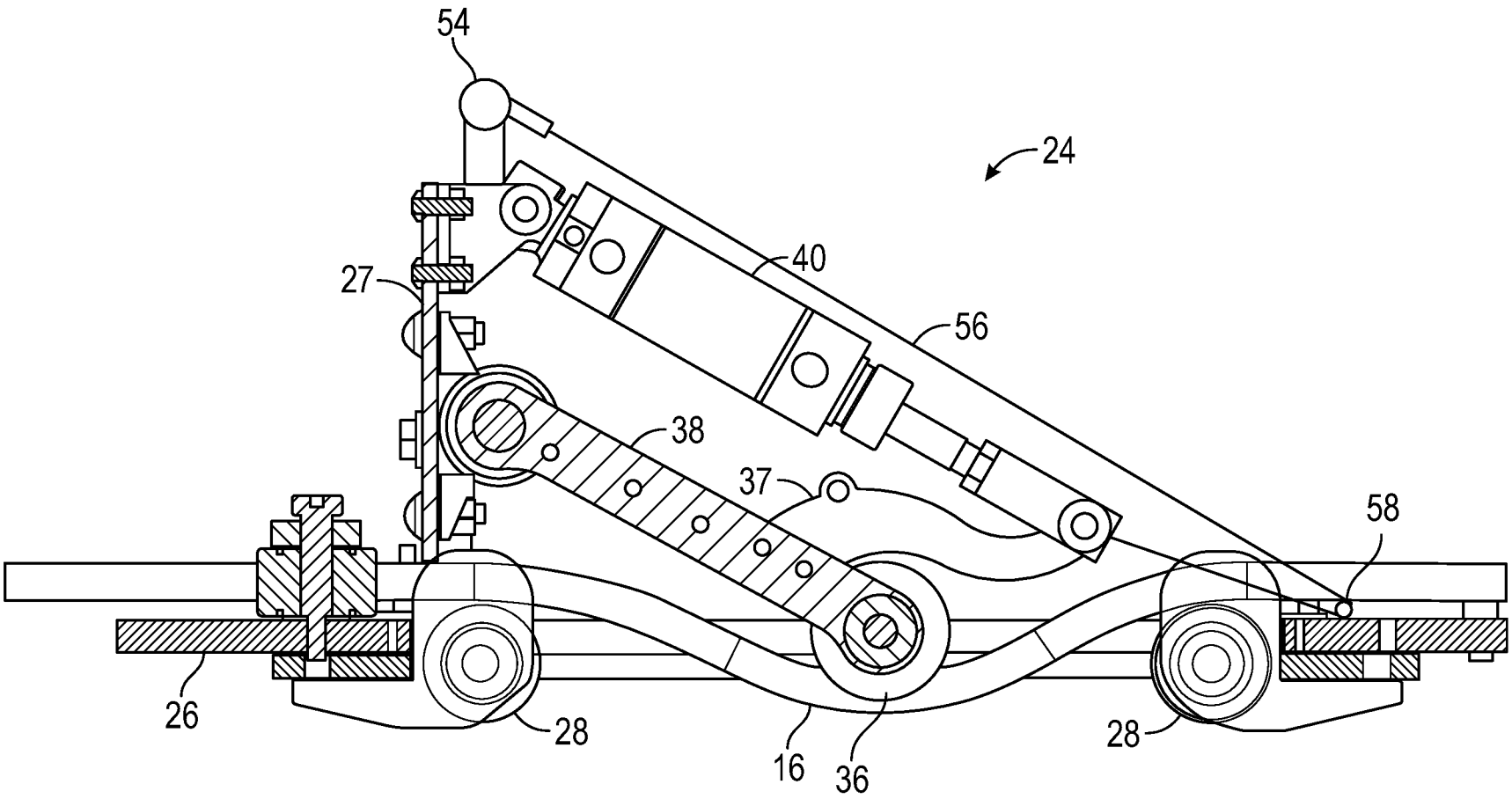
FIG. 3C depicts a side view of an aided freewheel winch assembly including a potentiometer relating to some embodiments.

Turning now to FIG. 3C, a side view of the aided freewheel winch assembly 24 is depicted including a potentiometer 54 relating to some embodiments. In some such embodiments, the potentiometer 54 may comprise a string potentiometer, as shown, or another type of potentiometer. The potentiometer 54 may be mounted on the rigid base structure 26, as shown, and may comprise a string 56 coupled to at least one of the roller 36, the arm 38, or the actuator 40.

In some embodiments, a looped anchor point 58 may be disposed on the rigid base structure 26, as shown, for receiving the string 56. Accordingly, the string 56 may be directed from the potentiometer 54 through the looped anchor point 58, and secured to the actuator 40 at an end of the string 56. Accordingly, the looped anchor point 58 may be configured such that the string 56 is able to freely slide through the looped anchor point 58. Accordingly, the potentiometer 54 is able to detect a change in length of the string 56 whenever the actuator 40 is moved. The measured change in length of the string 56 may be used to infer a deflection of the roller 36 and the arm 38. In some embodiments, the potentiometer 54 is configured to detect a deflection length of the string 56. Accordingly, the potentiometer 54 may be used to measure a change in position of the roller 36 based on a deflection length of the string 56.

It should be understood that a variety of different mounting positions of the potentiometer 54 are contemplated. For example, in some embodiments, the looped anchor point 58 may not be included and the string 56 may be secured directly to the actuator 40 or to the roller 36. Further, in some embodiments, other types of potentiometers may be used such as linear potentiometers, rotary potentiometers, or other suitable potentiometers operable to measure a change in position in at least one of the winch line 16, the arm 38, the roller 36, or the actuator 40. For example, a linear potentiometer may be mounted on or within the actuator 40 to measure an extension length of the actuator 40. Accordingly, if the roller 36 is deflected due to the tension in the winch line 16 from the operator force 42, a change in the extension length of the actuator 40 may be sensed by the linear potentiometer since the actuator 40 and the arm 38 are mechanically coupled, as shown. Further still, embodiments are contemplated in which a rotary potentiometer may be disposed at a connection point of the arm 38 to the rigid base structure 26 to measuring rotation of the arm 38 similar to the rotary encoder 48.

In some embodiments, other detection methods may be used in addition to or in place of the detection methods described above. For example, in some embodiments, a tensile force of the winch line 16 may be measured using a load cell. Accordingly, the load cell may be disposed on or near the roller 36, on the connecting member 37, or in another suitable location on the aided freewheel winch assembly 24. Further, in some embodiments, optical detection methods may be used. As such, in some embodiments, an optical sensor may be disposed adjacent to the winch line 16 to measure a deflection or a tension in the winch line 16 optically. For example, the optical sensor may detect a change in thickness of the winch line 16 due to a tension in the winch line 16 using optical techniques such as computer vision. Accordingly, in such embodiments, when the winch line 16 is pulled the tension stretches the winch line 16 such that the thickness of the winch line 16 is reduced proportional to the amount of tension in the winch line 16.

Figure 4:
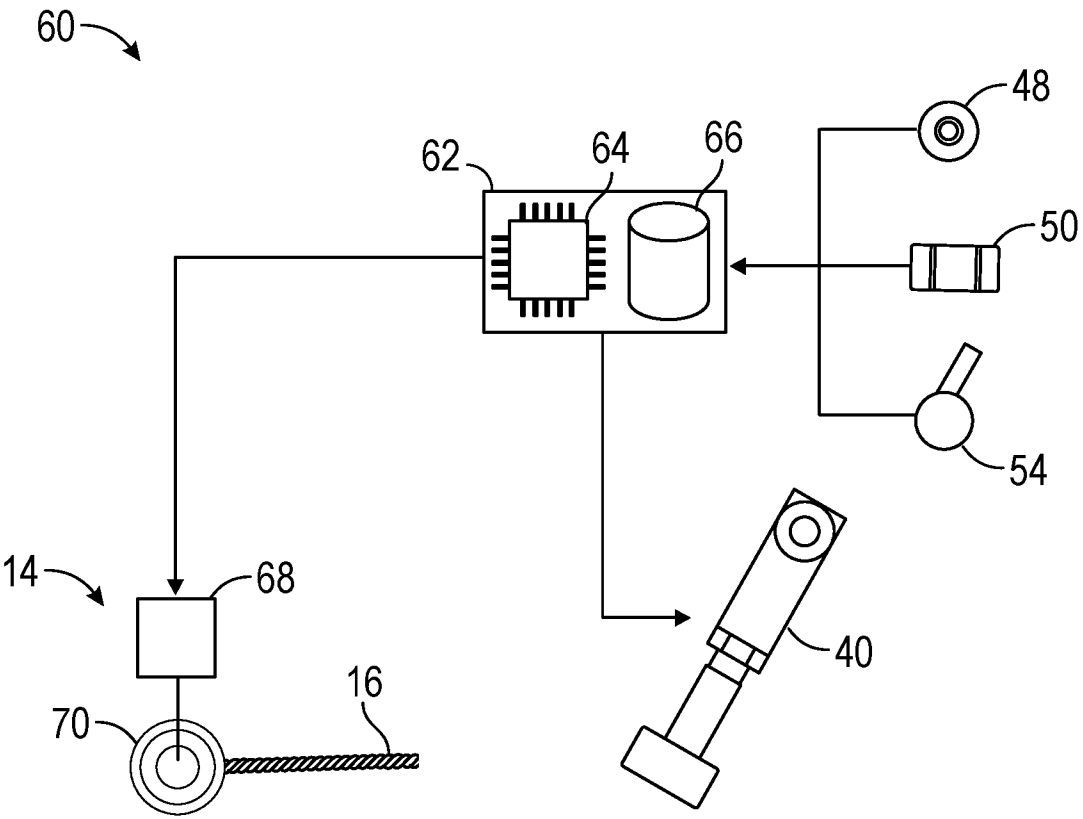
FIG. 4 depicts an exemplary control system relating to some embodiments.

Turning now to FIG. 4, an exemplary control system 60 is depicted relating to some embodiments. In some such embodiments, the control system 60 comprises a controller 62 which may be a microcontroller. In some embodiments, the controller 62 may be a controller of the utility vehicle 10 or a controller of the aided freewheel winch assembly 24 and/or the winch assembly 14. In some embodiments, the controller 62 comprises at least one processing element 64 and at least one storage element 66. In some embodiments, the storage element 66 stores computer-readable instructions that may be executed by the processing element 64 in order to control winch operation or to perform any other function described herein. For example, in some embodiments, a pay-in or pay-out function may be controlled by the at least one processing element 64 of the controller 62.

In some embodiments, the controller 62 receives a detection signal from one or more of the rotary encoder 48, the first inclinometer 50, and the potentiometer 54. Further, embodiments are contemplated in which other types of sensors may be included. Additionally, in some embodiments, more than one sensor may be used in order to determine a confidence level in a measurement. For example, a measured displacement from the rotary encoder 48 may be verified by a measured displacement from the inclinometer 50. Similarly, in some embodiments, multiple measurements may be compared from one or more of the same type of sensor. For example, a plurality of rotary encoders may be included such that the data from each of the plurality of rotary encoders may be compared to determine an average measurement.

In some embodiments, the controller 62 may be at least indirectly communicably coupled to the actuator 40 such that the controller 62 may control operation of the actuator 40. For example, in some embodiments, the controller 62 controls the magnitude of the exerted force 46 of the actuator 40. Alternatively, in some embodiments, the controller 62 may not control operation of the actuator 40 but may receive information indicative of the exerted force 46 from the actuator 40.

In some embodiments, the controller 62 is further coupled to the winch assembly 14 such that the controller 62 is operable to control at least one operation of the winch assembly 14 based on a signal indicative of a measurement from one of the sensors (rotary encoder 48, inclinometers 50, 52, potentiometer 54, or another suitable sensor). For example, a signal may be received by the controller 62 from the inclinometer 50 that is indicative of a change in position of the roller 36. Accordingly, the controller 62 may determine that operator 18 is pulling on the winch line 16 based on the received signal and transmit a pay-out signal to the winch assembly 14 requesting the winch assembly 14 to pay out the winch line 16.

In some embodiments, the winch assembly 14 comprises a winch motor 68 coupled to a winch drum 70 for holding the winch line 16, as shown. The winch motor 68 may be any suitable type of motor operable to rotate the winch drum 70, such as for example, a hydraulic motor, an electric motor, or a pneumatic motor. In some embodiments, the winch motor 68 of the winch assembly 14 may be hydraulically driven such that the controller 62 may control the winch motor 68 by adjusting a hydraulic valve, which is hydraulically coupled to the winch motor 68. Accordingly, the winch motor speed and direction may be controlled by adjusting the hydraulic valve. Embodiments are contemplated in which the controller 62 determines a winch motor speed for the pay-out function based on the received signal. For example, in some embodiments, if the operator 18 pulls harder on the winch line 16, the signal from the inclinometer 50 may be increased and the controller 62 may increase the winch motor speed based on the larger signal.

In some embodiments, the winch assembly 14 further comprises a winch brake. In some embodiments, the winch brake may provide a braking force to the winch line 16 during at least one operation. In some such embodiments, the winch line 16 may be released during a payout operation by relieving the braking force applied by the winch brake and allowing the tensioner motor 30 to pull the winch line 16 off of the winch drum 70. In some embodiments, this method of winch pay out may be used in a true freewheel mode of operation.

Figure 5:
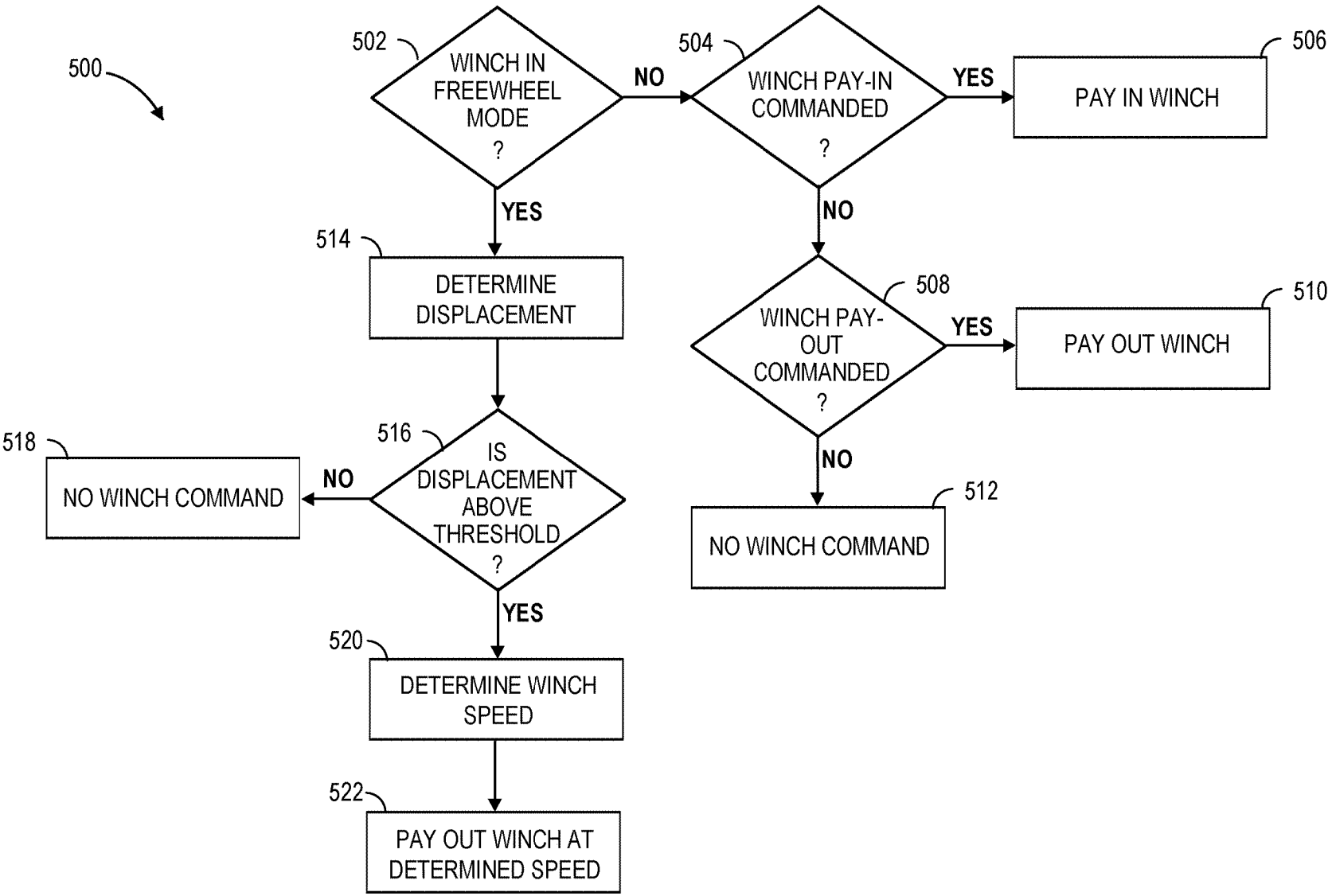
FIG. 5 depicts an exemplary flow diagram relating to some embodiments.

Turning now to FIG. 5, an exemplary flow diagram 500 is depicted relating to some embodiments. In some such embodiments, the flow diagram 500 may describe the operation of the controller 62 or of the aided freewheel winch assembly 24 as a whole. At step 502 it is determined whether the winch assembly 14 is in a freewheel mode. In some embodiments, the mode of the winch assembly 14 may be selected from one or more modes including at least a freewheel mode and a normal mode. In such embodiments, the operator 18 or another user may select the mode using an input device such as either of first input device 20 or second input device 22.

If it is determined that the freewheel mode is not selected then the process moves to step 504 where it is determined whether a winch pay-in operation is actively commanded. In some such embodiments, this determination may be made by checking inputs to either of the first input device 20 or the second input device 22. For example, the controller 62 may determine whether a winch pay-in button is currently being pressed down by the operator 18. If the winch pay-in operation is being commanded, then the winch assembly 14 pays in the winch line 16 at step 506 by driving the winch motor 68 in a pay-in direction. Alternatively, if the winch pay-in operation is not being commanded, it is determined whether a winch pay out operation is being commanded at step 508. If the winch pay-out operation is being commanded, then the winch line 16 is paid out at step 510 by driving the winch motor 68 in a pay-out direction, opposite the pay-in direction. Alternatively, if the winch pay-out operation is not being commanded, then no winch command is given at step 512.

If it is determined that the winch assembly 14 is in a freewheel mode at step 502 then the process continues to step 514 where a displacement indicative of an operator input is determined. In some embodiments, the displacement may be determined using one of the rotary encoder 48, the inclinometer 50, the potentiometer 54, or another suitable sensing device, such as a load cell or an optical sensor device. In such embodiments, the displacement may be indicative of an operator input such as the operator 18 pulling on the winch line 16. Next at step 516 it is determined whether the displacement is above a predetermined threshold value. Said predetermined threshold value may be selected such that the freewheel operation is not activated by small vibrations or noise within the aided freewheel winch assembly 24. Accordingly, if the displacement is not above the predetermined threshold value no winch command is given at step 518. In some embodiments, the displacement is disregarded if below the predetermined threshold to prevent unintentional operation of the winch motor 68. Alternatively, if the displacement exceeds the predetermined threshold value, a corresponding winch pay-out speed is determined based at least in part on the displacement at step 520. At step 522 the winch assembly 14 pays out the winch line 16 at the determined pay-out speed.

In some embodiments, the relationship of the displacement and the corresponding pay-out speed may be selected between a variety of different types. For example, in one embodiment, a linear correlation is created between the displacement and the speed such that the speed varies proportional to the displacement. Alternatively, in another embodiment, the speed may vary exponentially compared to the displacement. In a further embodiment, the speed may vary based on a square root correlation to the deflection. Further still, embodiments are contemplated where the operator 18 may specify a specific relationship between the measured deflection and the desired speed or select a relationship from a list of relationships such as the correlations described herein or other suitable correlations. Accordingly, in some embodiments, the operator may select the relationship based on a desired sensitivity for the winch pay-out speed in freewheel mode. In some embodiments, the winch speed may be changed by adjusting a hydraulic valve coupled to the winch motor 68 as described above. Accordingly, embodiments are contemplated in which the hydraulic valve is adjusted based on the magnitude of the measured deflection.

In some embodiments, a calibration may be made to determine the operator force corresponding to various displacements. For example, a minimum force value may be determined for which the winch should begin to pay out and a maximum force value may be determined associated with a maximum pay-out speed of the winch motor 68. In some embodiments, the predetermined threshold may be associated with the calibrated minimum force value such that the pay-out function is only triggered if the operator force exceeds the minimum force value.

It should be understood that the features and functionalities described with respect to the aided freewheel winch assembly 24 may be used in a variety of applications. For example, the aided freewheel winch assembly 24 may be used in association with the winch assembly 14 to provide winching operations such as removing a utility pole from the ground, towing a vehicle or some other structure, or maintaining tension to hold a structure in place. However, a variety of other applications not described herein are also contemplated. Accordingly, the aided freewheel winch assembly 24 may be used to provide aided freewheel operation to the operator 18 by detecting when the operator 18 pulls on the winch line 16. Accordingly, the operator 18 may not need to interact with other input devices 20 and 22 and the operator 18 can have both hands free to hold the winch line 16 or perform another task.

In some embodiments, the winch assembly 14 may be placed into a true freewheel state. For example, the operator 18 may select a button for entirely disengaging the winch drum from a gearbox such that the winch assembly 14 is in a true freewheel state distinct from the aided freewheel mode of operation described herein. In some embodiments, portions of the aided freewheel winch assembly 24 may be used independently for various applications. For example, the optical sensing method described above may be employed to measure rope tension in a range of different fields. Further, in some embodiments, the tensioner assembly 35 described above with respect to FIG. 2A may be used independently from the aided freewheel winch assembly 24 to maintain tension in the winch line 16. In such embodiments, aided freewheel functionality may or may not be included.

Although the invention has been described with reference to the embodiments illustrated in the attached drawing figures, it is noted that equivalents may be employed and substitutions made herein without departing from the scope of the invention as recited in the claims.

Having thus described various embodiments of the invention, what is claimed as new and desired to be protected by Letters Patent includes the following:

1. A system for aiding freewheel winch operation, the system comprising:
- a rigid base structure;
- a winch line;
- one or more winch guides secured to the rigid base structure, said one or more winch guides in contact with the winch line configured to reduce friction on the winch line during use;
- at least one contact device in contact with the winch line;
- an arm secured to the rigid base structure for supporting the at least one contact device;
- an actuator coupled to the arm for exerting a force on the at least one contact device,
- wherein the force maintains contact of the at least one contact device with the winch line;
- a winch motor configured for paying in and paying out the winch line; and
- a sensor configured to measure a change in a position of the at least one contact device,
- wherein the measured change in the position is indicative of an operator input,
- wherein an operation of the winch motor is controlled based at least in part on said operator input.

2. The system of claim 1, wherein the at least one contact device is at least one roller.

3. The system of claim 1, wherein the one or more winch guides are rotational pulleys.

4. The system of claim 1, further comprising a pneumatic actuator secured at one end to the rigid base structure for generating a force exerted on the at least one contact device by the arm.

5. The system of claim 4, wherein the change in the position is associated with an extension length of the pneumatic actuator.

6. The system of claim 1, wherein the sensor is an inclinometer and wherein the change in the position is associated with a measured angle of the arm from the inclinometer.

7. The system of claim 1, wherein the sensor is a rotary encoder and the change in the position is associated with a measured rotation of the arm from the rotary encoder.

8. A device for aiding winch operation, the device comprising:
- a rigid base structure;
- a winch line;
- one or more winch guides secured to the rigid base structure and in contact with the winch line for reducing friction on the winch line as the winch line is moved;
- a roller in contact with the winch line;
- a winch motor operatively connected to the winch line; and
- a sensor disposed on or adjacent to the roller for measuring a change in a position of the roller,
- wherein the measured change in the position is indicative of an operator input,
- wherein operation of the winch motor is controlled based at least in part on the measured change in the position from the sensor, and
- wherein if the change in position is below a predetermined threshold, the change in position is disregarded to prevent unintentional operation of the winch motor.

9. The device of claim 8, further comprising:
- an arm having a first end and a second end, said arm being movably attached to the rigid base structure at the first end, wherein the roller is rotatably attached to the second end of the arm for contacting the winch line during a freewheel operation mode.

10. The device of claim 9, wherein the winch motor is a hydraulic motor, further comprising a hydraulic valve coupled to the hydraulic motor for controlling the motor.

11. The device of claim 10, wherein the hydraulic valve is configured to be adjusted proportional to the change in the position.

12. The device of claim 9, wherein the device is selectively adjustable from a normal operation mode to a freewheel operation mode.

13. The device of claim 12, wherein when the device is in the freewheel mode the sensor is engaged.

14. The device of claim 12, wherein when the device is in the normal operation mode, at least one input device receives one or more winch commands for controlling operation of the winch motor.

15. An aided freewheel winch assembly, the assembly comprising:
- a rigid base structure;
- one or more winch guides secured to the rigid base structure and in contact with a winch line of a winch assembly for reducing friction on the winch line as the winch line is moved; and at least one sensor disposed adjacent to the winch line for detecting a tension in the winch line indicative of an operator input, wherein a pay-out function of the winch assembly is controlled based at least in part on said operator input.

16. The assembly of claim 15, further comprising a tensioner assembly, wherein a constant tension is maintained within the winch line using the tensioner assembly.

17. The assembly of claim 16, wherein the tensioner assembly comprises:

a tensioner motor;

a tensioner sheave rotatably coupled to the tensioner motor for receiving the winch line; and a tensioner cylinder for selectably engaging and disengaging the tensioner assembly from the winch line.

18. The assembly of claim 16, further comprising a winch drum, wherein at least a portion of the tensioner assembly is disposed along a path of the winch line between the at least one sensor and the winch drum.

19. The assembly of claim 15, further comprising:

an arm having a first end and a second end, said arm being movably attached to the rigid base structure at the first end, wherein the at least one sensor is disposed on the arm; and a roller rotatably attached to the second end of the arm for contacting the winch line during a freewheel operation mode.

20. The assembly of claim 19, further comprising:

an actuator rotatably attached to the rigid base structure operable to exert a predetermined force; and a connecting member having a first end and a second end, said connecting member coupled to the actuator at the first end and coupled to the arm at the second end for transferring the predetermined force to the arm, wherein the predetermined force maintains contact of the roller with the winch line during the freewheel operation mode.

* * * * *